United States Patent [19]

Hellums et al.

[11] 3,983,938

[45] Oct. 5, 1976

[54] FREELY SLIDABLE PARAFFIN SCRAPING AND REMOVING TOOL FOR CLEANING OIL WELL TUBING

[76] Inventors: Terrel B. Hellums, Rte. 2, Box 180A; Jess Sanford Hellums, Jr., 620 Frio, both of Lockhart, Tex. 78644

[22] Filed: July 28, 1975

[21] Appl. No.: 599,408

Related U.S. Application Data

[62] Division of Ser. No. 425,295, Dec. 17, 1973, Pat. No. 3,912,007.

[52] U.S. Cl. ..... 166/175; 166/176

[51] Int. Cl.[2] ..... E21B 37/02

[58] Field of Search ..... 166/175, 176, 170, 173; 308/4 A

[56] References Cited

UNITED STATES PATENTS

| | | | |
|---|---|---|---|
| 1,755,762 | 4/1930 | Armstrong et al. | 166/175 |
| 1,758,995 | 4/1930 | Armstrong et al. | 166/175 |
| 2,846,016 | 8/1958 | Hanes | 166/173 |
| 3,537,519 | 11/1970 | Long | 166/175 |

*Primary Examiner*—James A. Leppink
*Attorney, Agent, or Firm*—Clarence A. O'Brien; Harvey B. Jacobson

[57] ABSTRACT

A simple cylindrical paraffin scraping tool adapted to slidably ride up and down between spaced apart stop means on a sucker rod to scrape and remove hardened paraffin and similar deposits from the interior walls of oil well tubing with the scraping tools stored in operative readiness within the well during pumping of the oil well so that the scraping apparatus is immediately available when it becomes necessary to clean the well. Some minor preventive maintenance may be performed during continued pumping of the oil well by incidental agitation of the scrapers preventing and slowing the formation of deposits in the oil well tubing but the principal scraping operation occurs when and as the sucker rod line and attached plurality of scraper tools are pulled out of the well for periodic pump changes.

11 Claims, 14 Drawing Figures

32
30
34
25
21
23
30
33
32

32
25
21
23
33
30
32
34
32

30
21
33
32
34
30
21
33
30
32

45
43
46
43
41
47
44
47
46
42

55
53
53
57
57
56
51
52

FREELY SLIDABLE PARAFFIN SCRAPING AND REMOVING TOOL FOR CLEANING OIL WELL TUBING

This is a division, of application Ser. No. 925,295, filed Dec. 17, 1973 now U.S. Pat. No. 3,912,007.

SUBJECT MATTER OF THE INVENTION

This invention relates generally to tools and equipment for scraping and removing paraffin from the interior walls of oil well tubing and relates more specifically to oil well paraffin scraping and removing tools and apparatus that can be stored in semi-passive state within the oil well during pumping to be available for immediate use when needed with minimum interruption of pumping operations.

THE PRIOR ART

Most crude oil contains varying amounts of paraffin and occasionally asphalt particles which tend to become deposited on the interior walls of the tubing employed in oil wells. In order to maintain pumping production from wells in which obstructions of paraffin and or asphalt particles have been deposited on the walls of the tubing it is necessary from time to time to scrape and remove said deposits. In some instances this is done by periodically employing expensive and complicated paraffin scraping and removing tools which are usually attached to and pushed through the oil well tubing by the sucker rods employed in the oil well. This is a complicated operation requiring the removal of the sucker rod string for insertion of the paraffin scraper tool or tools with operation of the well being interrupted from one to several days while the expensive scraper tools are inserted into the well, the scraping operation completed and then removed. The extra work, expense and production interruption can prove prohibitively expensive in the case of so called low quality oil wells. When the build up of exceptionally sticky paraffin and asphalt becomes excessive and proves too difficult for removal by ordinary tools it becomes necessary to pull the tubing string out of the oil well and burn the tubing in order to melt the obstructing deposits of paraffin and asphalt out of the interior of the tubing pipes. This later procedure of pulling the tubing string may involve an interruption of production extending over several weeks at very great expense.

There has been an abundance of prior patent art proposals for special complicated tools with a number of the tools being commercially available — usually on a temporary lease or rental basis. By far and large the tools that have been proposed that are simple in construction and low in expensiveness have failed to work satisfactorily while the complicated tools have often involved expensive outlays that were excessive for rehabilitation of marginal low grade wells. There has therefore been a long continuing need for a very simple durable paraffin scraping and removal tool that is so inexpensive in cost and so indestructible in structure as to permit the tool to remain in place semi-permanently concurrently with continued pumping production of the well.

OBJECTS OF THE INVENTION

A primary object of the invention is to devise a simple durable and inexpensive paraffin scraping and removal tool that can be semi-permanently installed on the oil well sucker rod string that can remain operative and in place concurrently with pumping production thereby minimizing the expense and down time involved in pulling the oil well tubing for cleaning purposes.

Another object of the invention is to devise an inexpensively manufactured and nearly indestructable paraffin scraping tool that will have no moving parts to break off, that will be so impervious to wear by semi-permanent installation and usage as to make it practical for the operator to install a plurality of said paraffin scraping tools in an oil well and leave them in place.

Still another object of the invention is to devise a paraffin scraper tool that can be left in the well semi-permanently during pumping operations so as to provide continuous agitation and scraping action in order to prevent the build up of paraffin or asphalt deposits before stubborn tenacious deposits have formed.

To the extent that it may be necessary for the paraffin scraper recommended herein to operate in conjunction with a valve or seat valve, it is an object of this invention to devise and employ a valve structure having minimum possibility of sticking and a valve design that can be operated from the surface — when necessary.

It is an object of this invention to devise a paraffin scraper tool that can rise through a limited distance with the up-flow of oil through the oil well tubing or by gravity fall by its own weight through a limited distance but with means for supplemental hammer driving of the scraper tool by lifting or dropping the weight of the sucker rod line through an extended piston stroke so as to drive the upper and lower stop means against the top or the bottom of the scraper tool.

Still a further object of the invention is to devise a paraffin scraping tool of such substantial structure as to have use-value in hammering out dents in the walls of the oil well tubing by using the weight of the sucker rod string to drive the scraper tool through the dented area in the tubing.

These and other objects and advantages of this invention will become apparent through consideration of the following description and appended claims in conjunction with the attached drawings in which:

DESCRIPTION OF THE SEVERAL VIEWS IN THE DRAWINGS

Figure 2:
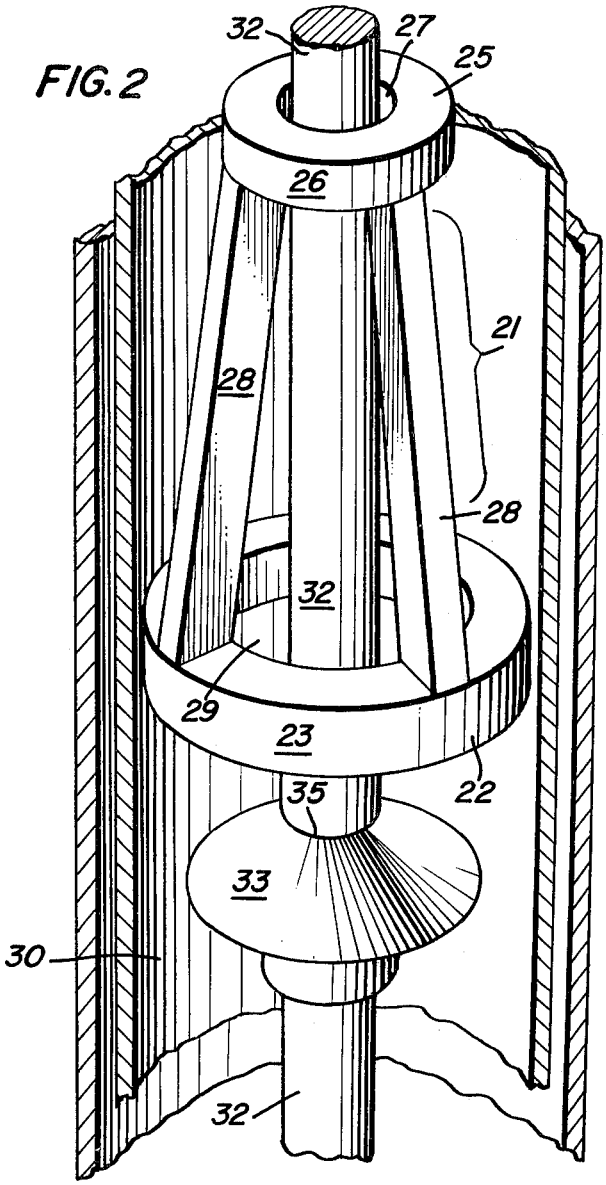
FIG. 2 is a perspective view of the slidable paraffin scraping and removing tool positioned on a sucker rod over the frustro-conical seat valve within an oil well tubing.

In describing one selected form or preferred embodiment of this invention as shown in the drawings and described in this specification, specific terms and components are used for clarity. However, it is not intended to limit the claimed invention to the specific form, components or construction shown and it is to be understood that the specific terms used in this illustration of the invention are intended to include all technical equivalents which operate in a similar manner to accomplish a similar purpose.

DETAILED DESCRIPTION OF PREFERRED EMBODIMENT OF INVENTION

Figure 1:
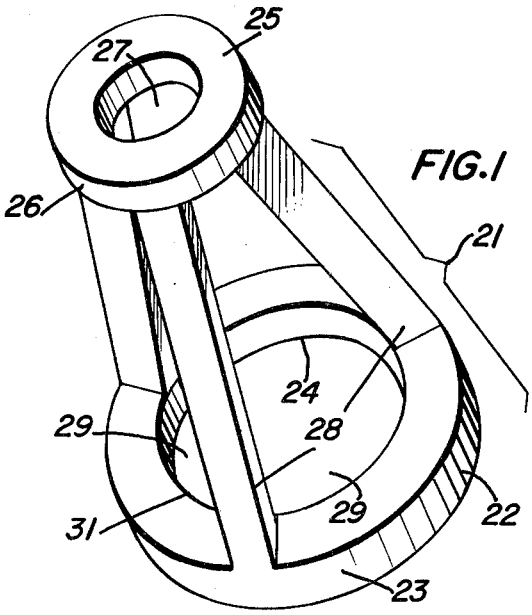
FIG. 1 is a perspective view of the top of the slidable paraffin scraping and removing tool.

Referring to the specific embodiment of the invention selected for illustration in the accompanying drawings, the freely slidable paraffin scraping and removing tool as illustrated in FIG. 1 is designed generally or as a whole by the number 21. Said freely slidable paraffin scraping and removing tool 21 has an annularly shaped paraffin cutting and scraping ring 22 that is of such size and has an exterior circumference 23 designed to fit snugly into the interior of one of the standard sizes of oil well tubing so that its outside circumference will rub or scrape against the walls of the tubing as said scraping tool falls or is pushed through the tubing. The size and thickness of paraffin scraping and cutting ring 22 serves in part as a weight affecting the rate of fall of the tool within the oil well tubing and this scraping and cutting ring 22 can be increased in length to form a skirt ring like that illustrated in FIG. 9 and FIG. 10 in cases where additional strength or weighting is needed. The interior circumference 24 of paraffin scraping ring 22 is of sufficient diameter to permit the passage of a standard size sucker rod 32 through the center of said scraper ring and leave sufficient additional open space between said co-axially mounted sucker rod 32 and the interior circumference 24 of the scraper ring to permit crude oil and dislodged mud, paraffin and asphalt particles to pass between the sucker rod and the interior walls 24 and scraper ring 22. The forward scraping edge surface of scraper ring 22 may be left blunt on some scraper tools as implied in FIG. 1 or may be provided with a cutting edge or blade 37 cut into the forward surface of cutting ring 22 as illustrated in FIGS. 4 and 5 of Drawings.

At a spaced apart distance above the paraffin scraping ring 22 there is provided an upper annularly shaped aligning and centering guide collar 25 having a guide collar outside circumference surface 26 that is distinctly smaller than the outside circumference 23 of scraping ring 22 leaving room for crude oil and paraffin particles to pass between guide collar 25 and the interior walls of oil well tubing 30. Through the center of guide collar 25 there is provided a centering guide hole aperture 27 that maintains scraper tool 21 in parallel alignment between the moving sucker rod 32 and the interior walls of oil well tubing 30.

Figure 4:
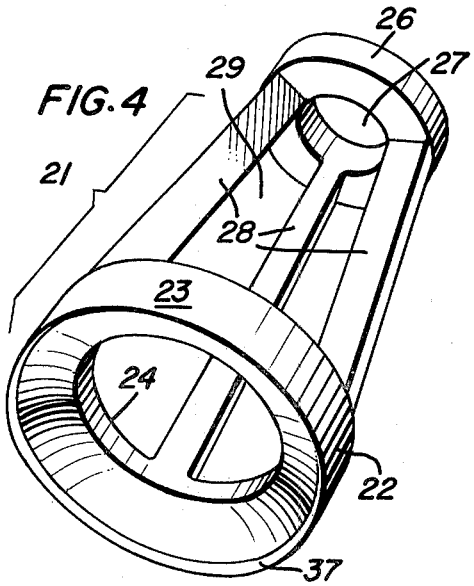
FIG. 4 is a perspective view of the bottom of the slidable paraffin scraping and removing tool showing the concave arcuate cutting blade in the underside of the lower ring of the tool.
Figure 5:
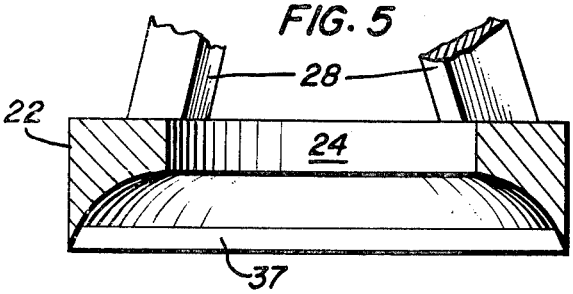
FIG. 5 is a partial cut-away cross-section view of the lower annular paraffin cutting and scraping ring of the tool showing the nature of the concave arcuate cutting blade.

Paraffin scraping ring 22 is held in spaced apart position from the upper annularly shaped aligning and centering guide collar 25 by means of a plurality of circumferentially spaced apart spacer legs 28—28 that are formed by elongated metal bars of rectangular cross section arranged in an inclined slope between the paraffin cutting and scraping ring 22 and upper aligning and centering guide collar 25 as illustrated in FIGS. 1, 2 and 4 in the Drawings herein. Said plurality of spacer legs 28 — 28 are mounted in a circular arrangement such that the narrow side of each of the spacer legs faces toward the outside circumference of said scraper ring 22 and guide collar 25 leaving maximum open area exit flow ports 29 — 29 between pairs of said spacer legs 28 — 28 so that crude oil and dislodged paraffin particles flowing upward through oil well tubing 30 can freely pass through the central opening 31 within scraper ring 22 and then out and up through the exit flow ports 29 — 29 between spacer legs 28 — 28. Since said upper centering and guide collar 25 is distinctly smaller than the inside diameter of oil well tubing 30 it is possible for the upward moving crude oil to flow around and past said guide collar 25 without interruption of the oil flow.

A tubular guide hole aperture 27 is provided through the center thickness of said aligning and centering guide collar 25 having a diameter slightly larger than the diameter of the sucker rod 32 being employed in the oil well and said paraffin scraper tool 21 is co-axially mounted at spaced apart intervals on the oil well string of sucker rods 32 — 32 with each scraper tool 21 being free to slide up and down between adjacent pairs of spaced apart stop means 33 – 34. Both of said stop means are mounted on a single length of sucker rod 32 and a particular scraping tool 21 will therefore be limited to oscillating up and down between the particular pair of stop means 33 – 34 so that a plurality of such scraper tools 21 — 21 will be used on the sucker rod string for a particular well to cover the tubing area where experience indicates that paraffin deposits are most likely to occur. In most instances the upper stop means will usually be the joint coupling or rod box 34

Figure 7:
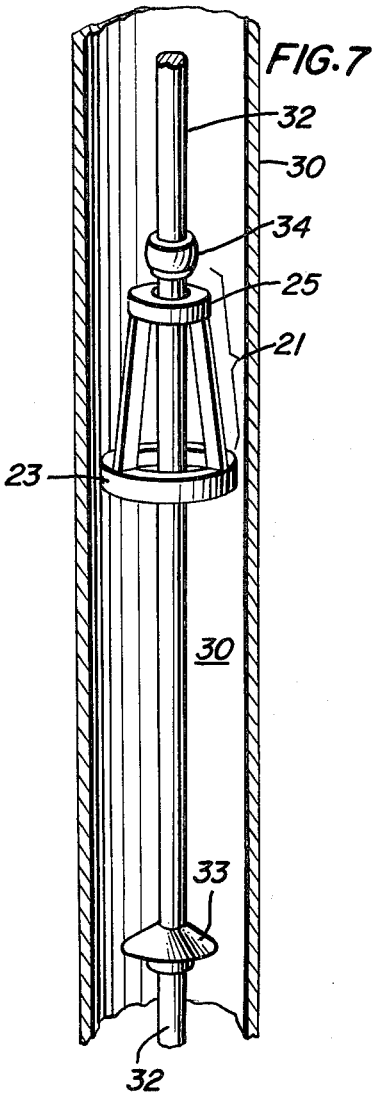
FIG. 7 is a perspective illustration showing how the slidable paraffin removal tool meets the bottom of a rod box stop within the oil well tubing.
Figure 8:
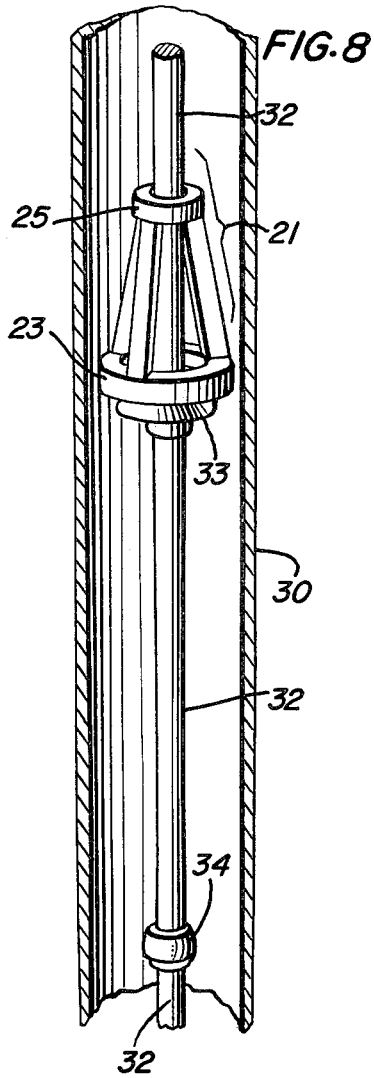
FIG. 8 is a perspective view of the slidable paraffin scraping and removing tool as it fits on the top surface of the frustro-conical seat valve within the oil well tubing.
Figure 6:
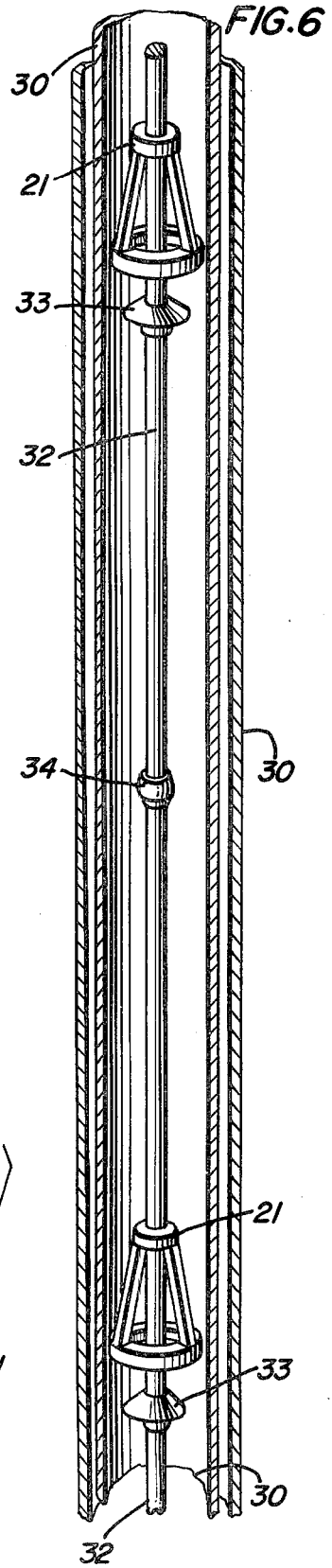
FIG. 6 is a perspective view of how two slidable paraffin scraping and removing tools may be spaced apart on successive sucker rods within an oil well tubing in relation to two frustro-conical seat valves and a rod box used as spaced apart stop means.

(FIG. 7) which is of sufficient size and strength to serve as a means of employing the weight of the sucker rod line to hammer the upper shoulder of guide collar 25 when it may be necessary to hammer drive paraffin scraper tool 21 through a particularly tenacious deposit of paraffin or asphalt. Rod box 34 can be employed as a lower stop means in many instances, but in more frequent situations a frustro-conically shaped seat valve structure 33 will be employed as the lower stop means. Said frustro-conical shaped seat valve structure 33 should be provided with an outside diameter smaller than the inside diameter of oil well tubing 30 so that crude oil can flow upward between the periphery of said cone shaped seat valve stop structure and the walls of oil well tubing 30. In addition, the upper surface of said cone shaped stop means 33 should be shaped and adapted to fit or nest just into the concave arcuate cutting blade 37 of paraffin scraper ring 22. As shown in FIG. 8. This truncated frustro-conical seat stop structure 33 has a tubular opening 35 vertically cut through conical seat stop structure 33 to permit said valve stop means to be concentrically mounted at a selected place on sucker rod 32. There is also provided an appropriate securing means 36 to permit said seat valve stop means 33 to be attached to the sucker rod. It will be readily appreciated from examination of the drawings herein that the shape and size of said cone shaped seat valve 33 will permit oil to flow upward around the edges of said valve but that more solid particles of dislodged asphalt and paraffin will have difficulty falling past cone shaped seat valve stop means 33 to lower depths in the well. When periodic complete cleaning of the well requires the pulling of sucker rod line 32 it will be apparent that, as said sucker rod line 32 is pulled upward that seat valve 33 will be driven into the center opening of scraper ring 22 virtually closing and sealing oil well tubing 30 so that all debris and particles of paraffin and asphalt will have to be driven ahead of the combined sweep of the scraper tool plus the closure of the seat valve into the scraper tool. As said sucker rod line continues to be pulled the collected debris and particles of asphalt and paraffin are pulled to the surface where they spill out of the well.

It is the contention of these Inventors that said simplified paraffin scraper tool 21 is novel and unique within itself as an inexpensive and nearly indestructable fool proof tool. However, the Inventor would also assert and argue that the combined system of the described paraffin scraper tool plus the associated use in connection with the sucker rod string and reciprocal oscillation of a plurality of scraper tools between specially shaped spaced apart stop means constitutes an apparatus system of unique versatility and utility.

It should be appreciated that once the utility of this simplified tool structure is disclosed that a variety of functionally equivalent structures can be improvised to perform the same functions in a similar manner within the spirit and purpose of the invention. Under the circumstances, the Inventor would like to illustrate and claim protection for two of the more basic functionally equivalent tool structures that he feels should be within the scope of the invention.

Figure 9:
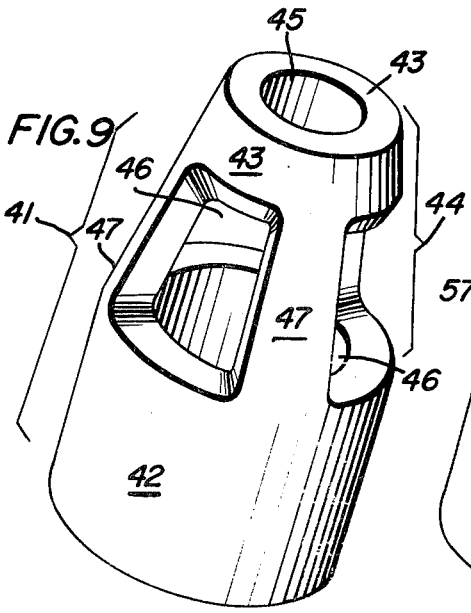
FIG. 9 is a perspective drawing of an alternate version of the slidable paraffin scraping and removing tool where the aligning and centering guide collar is a cone shaped extension of the tubular casting of the paraffin scraping ring.

FIG. 9 of the Drawings herein illustrates the manner in which the basic functional features of the tool could be cast or machined from a unitary length of metal bar material that would create a more presentable tool free of welded joints that might break during hammering of the tool in the oil well. Moreover, the employment of a smoother truncated cone shape for the upper portion of said unitary paraffin scraper tool 41 reduces the danger of the tool hanging up in the well during the process of pulling the sucker rod line.

In this alternate version of the paraffin scraper tool contemplated by these Inventors said paraffin scraper tool 41 has been provided with a cutting ring 42 having an extended length or skirt in order to indicate that the skirt length of said scraping ring 42 can be lengthened to the extent that may be needed in order to supply additional strength or added weight when the modified tool is used to remove stubborn asphalt deposits or when the tool is used to wedge and hammer out dents in the walls of the oil well tubing. Except for the change in size, utility and weight caused by the increase in skirt length, modified scraper ring 42 is the functional equivalent of scraper ring 22 in the preferred version of the invention.

The major changes in this modified version of the invention relate to fabrication of the upper part of the modified paraffin scraper tool 41 from a casting or machined unitary metal body in which the upper portion of the tool takes the form of a truncated cone 42 continuous with and setting on top of the cylindrically shaped tubular paraffin scraping ring. The upper annularly shaped aligning and centering guide collar 43 is spaced apart from scraper ring 42 but is cast or machined as an integral or unitary part of the overall tool 41 with a tubular guide hole aperture 45 provided through said tubular aligning and centering guide collar 43. Into the face of the inclined portion of truncated cone 44 there is cut a plurality of open space apertures forming exit flow ports 46 — 46 which permit oil and dislodged paraffin particles to flow through the scraper tool and out via said exit ports 46 — 46. The portion of the material remaining in the truncated portion of cone 44 after cutting out exit ports 46 — 46 constitute a plurality of circumferentially spaced apart vertical spacer legs 47 — 47 interconnecting and separating paraffin cutting and scraping ring 42 and aligning and centering guide collar 43.

Figure 3:
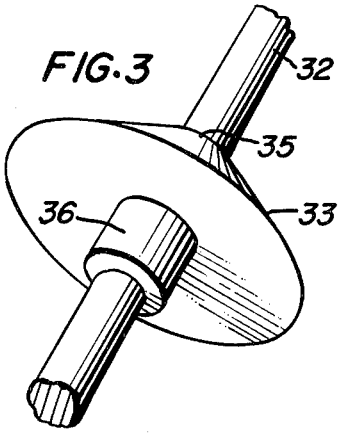
FIG. 3 is a perspective view showing the bottom surfaces of the frustro-conical seat valve and how it fits onto an oil well sucker rod.

With the exceptions already referred to above, the various parts of the modified unitary scraping tool 41, the various component parts of unitary cone shaped scraper tool 41. have approximately the same relative size and function as the equivalent parts of paraffin scraper 21 and no effort will be made to further duplicate the descriptive material already set forth above. However, it should be expressly noted that when cone shaped scraper tool 41, or any of the equivalent scraper tools, is fabricated from heavy durable materials and is provided with an extended heavy skirt scraping ring 42 as shown in FIG. 9 of the drawings that an additional non-scraping function of element of utility becomes possible. When a minor cave-in or dent occurs in installed tubing and the operator wants to hammer out or remove said dent, the operator can lift the sucker rod line, which weighs several thousand pounds, and then drop the combined weight of the sucker rod line so that such weight strikes or hammers on the upper shoulder of guide collar 43 until tool 41 immediately above the cave in or dent is driven or hammered through the caved-in spot in the oil well tubing until the caved-in spot is forcefully dialated or distended back to the approximate original shape of the oil well tubing. This is a remarkably unique and useful co-function not found in other oil well scraper tools. It should also be readily apparent that the unitary scraper tool 41 illustrated in FIG. 4 can be used in the system of apparatus previously described in connection with the preferred version of the invention illustrated in FIGS. 1, 2 and 3 herein. When scraper tool 41 is to be used for hammering out dents and stubborn obstructions, scraping ring 42 should be provided with blunt or square forward scraping edge but in some applications it will be desirable to have an arcuate cutting edge, like that illustrated in FIG. 5 cut into the undersurface of said tubular scraping ring to provide both cutting and scraping action against the inside walls of the oil well tubing being cleaned.

Figure 10:
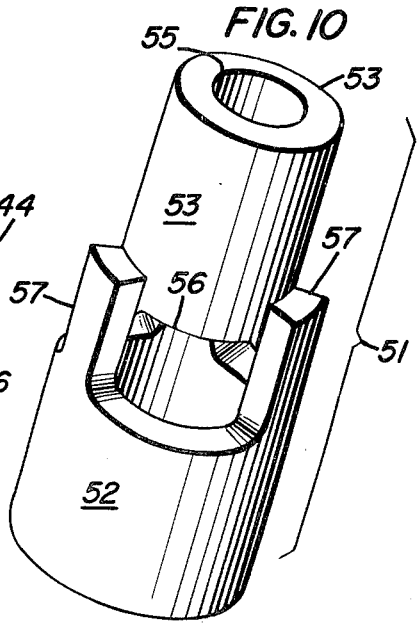
FIG. 10 is a perspective view of the top of another alternately stacked version of the slidable paraffin scraping and removing tool where the tool is made from two different sizes of thick metal tubing.

A third basic alternate version 51 of the paraffin scraper tool claimed as part of this invention is illustrated in FIG. 10 of the Drawings herein. This third version can be improvised or manufactured from two short lengths of tubular pipe of selected diameter. Paraffin scraping ring 52 is a selected length of tubular pipe of such exterior circumference and size as to just barely fit into and frictionally engage and scrape the interior walls of one of the standard sizes of oil well tubing. In the case of this alternate version, however, the plurality of circumferentially and evenly spaced apart exit flow ports 56 — 56 are cut into the upper portion of the length of tubular pipe from which scraper ring 52 is fabricated with the remaining space and material after cutting out exit ports 56 — 56 constituting circumferentially spaced apart vertical spacer legs 57 — 57 in continuing alignment with the interior and exterior tubular surfaces of said paraffin scraper ring 52. The upper annularly shaped aligning and centering guide collar 53 is fabricated from a short length of metal tubular material of such circumferential size as to snugly fit into and just inside of the upper ends of spaced apart vertical spacer legs 57— 57 as illustrated in FIG. 10 of the Drawings. The tubular pipe selected for upper guide collar 53 should have an inside diameter or circumferential guide hole aperture 55 larger than the diameter of the sucker rod being employed in the oil well. Except for the unusual appearance caused by stacking upper guide collar 53 on top of scraper ring 52 and the simplified manner in which the plurality of circumferentially spaced apart vertical spacer legs 57 — 57 are fabricated to separate and interconnect guide collar 53 and scraper ring 52, the remainder of the structure of this stacked alternate version of the paraffin scraper ring contemplated by this invention is so completely analogous to the equivalent parts of paraffin scraper tool 21 as to not require further elaboration. It also follows that this alternate stacked version of paraffin scraper 51 can also be used with the previously described systems of oil well cleaning apparatus and that paraffin scraper ring 52 can also be provided with an additional arcuate cutting blade cut into the undersurface of said tubular scraping ring 52 like the blade illustrated in FIG. 5 of the Drawings to provide both cutting and scraping action against the inside walls of the oil well tubing being cleaned.

The several alternate versions of the oil well paraffin scraper tools discussed above are all designed for hammered brute force scraping of stubborn paraffin and asphalt deposits from the walls of oil well tubing. There are instances, however, when the agitation caused by oscillation or reciprocal movement of a scraper tool during pumping operations as well as when the sucker rod string and attached scraper tools are being removed could contribute to prophylactic prevention of deposit build ups in the oil well tubing. It will usually be desirable to use one of the first three versions of the paraffin scraper tool described herein at the well bottom end of the sucker rod string with a cone shaped stop means 33 to close off and seal this last scraping and cleaning tool as the sucker rod string is pulled to the surface with all of the sludge and dislodged particles of paraffin and asphalt driven ahead of this last scraper tool. However, it would be useful for part or all of the slidable and fluctuating scraper tools at the intermediate levels of the well to be able to scrape and/or cut as they move either up or down.

Figure 13:
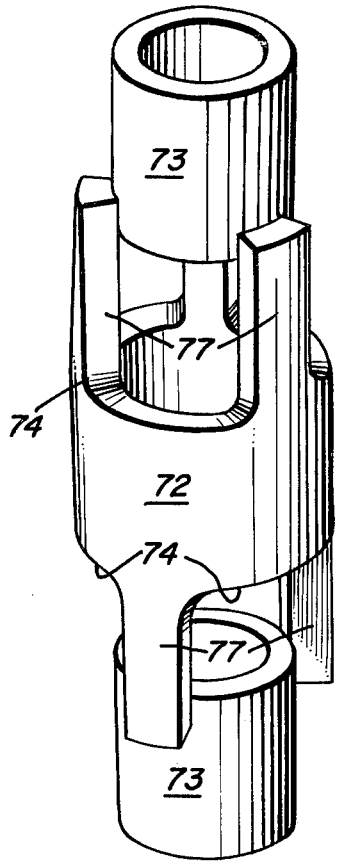
FIG. 13 is a perspective view of another double ended version of the paraffin scraping and removing tool with two smaller guide scraping collars on either end of a larger paraffin removing ring having a concave arcuate cutting blade in the top surface.
Figure 12:
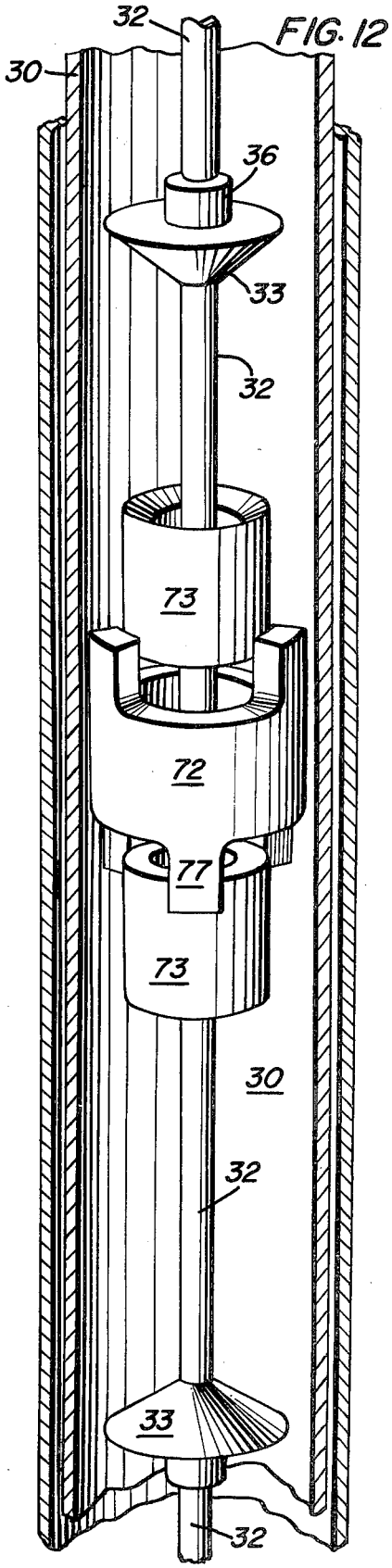
FIG. 12 is an illustration of how another alternate version of the double ended paraffin scraping and removing tool works within the oil well tubing and casing against two oppositely directed frustro-conical seat valves.
Figure 14:
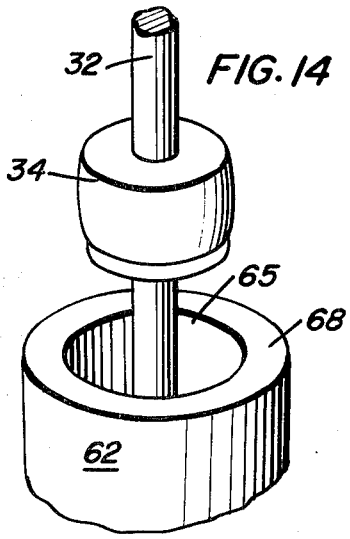
FIG. 14 is a fragmentary, perspective view showing a version similar to that of FIG. 11 arranged on a sucker rod in FIG. 11 showing a blunt end version and how a rod box may seat inside the end.
Figure 11:
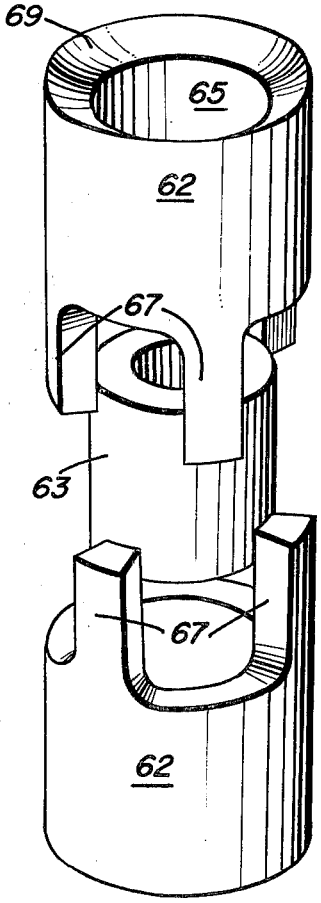
FIG. 11 is a perspective drawing of a double ended version of the paraffin scraping and removing tool with the larger paraffin scraper rings on either end of the aligning connective guide collar with the top ring showing the concave arcuate cutting blade.

The inventors therefore propose to manufacture a double ended version of the paraffin scraping tool, as illustrated in FIGS. 11, 12 and 13 of the drawings herein. The double ended stacked tool disclosed in FIG. 11 is an expanded version of scraper tool 51 disclosed in FIG. 10 in which a tubular cutting ring 62 — 62 is mounted on each end of tubular annularly shaped aligning and centering connective guide collar 63 so that a scraping ring projects in each of the vertical directions. Except for stacking a cutting ring 62 on each end of connective central collar 63 each of the parts in said double ended stacked paraffin scraper tool perform the same functions as the equivalent parts of single ended paraffin scraper tool 51 previously discussed. Each of said scraper rings 62 — 62 can be provided with a square or blunt forward scraping surface 68 as illustrated in FIG. 14 or alternatively each said scraper rings 62 — 62 can be provided with an arcuate cutting blade 69 — 69 cut into the forward scraping surface of each of the double ended scraper rings 62 — 62 to provide both scraping and cutting action against the inside walls of the oil well tubing being cleaned. When the alternate structure disclosed in FIG. 11 is employed for the paraffin scraper tool, and it proves desirable to drive or hammer the scraping tool to some extent it will prove desirable to use connective rod box 34 — 34 as both the upper and lower stop means. Note that FIG. 14 of the Drawings illustrates how sucker rod string 32 and connective rod box 34 can be driven through the tubular opening 65 in scraper ring 62 strike and hammer on the shoulder end of central connective collar 63 — and either end of connective collar 63 can be hammered by an upper or lower rod box stop means 34 to drive the scraper tool either up or down.

Another alternate version of a double ended paraffin scraper employing the inventive features of this invention is illustrated in FIG. 13 and use or application of this double ended scraper tool as an intermediate scraper is illustrated in FIG. 12. In this instance the primary cutting or scraping surfaces are built into the port openings 74 — 74 of a large double ended scraper ring 72 while a pair of aligning and centering collars 73 — 73 are mounted within extended spacer legs 77 — 77. The top and bottom ends of the pair of centering collars 73 — 73 can be left blunt to scrape larger deposits of paraffin and asphalt off of sucker rod 32 as illustrated in FIG. 13 and driven or hammered by rod box stop means 34— 34 or the forward ends of centering collars 73— 73 may be provided with arcuate cutting blades cut into the forward end surface of the centering collars 73 — 73. The principle utility of this alternate version of the double ended paraffin scraping tool will be found in employing either of the double ended scraper tools at intermediate levels in oil wells as illustrated in FIG. 12. FIGS. 11 and 13 show the double ended scraper tools alone while FIG. 12 illustrates an application of a double ended scraper tool at an intermediate level in a system of apparatus for scraping and cleaning oil well tubing. The elements and functions of these double ended scrapers as a part of a system of apparatus for cleaning oil well tubing is so clearly analogous to the equivalent elements and functions in the previous versions of this invention that there should be no need to repeat these now obvious explanations at this point.

OPERATION

In actual operation a plurality of any of the proposed scraper blades are mounted at spaced apart positions on the sucker rod string as it is assembled and lowered into the oil well. Each of said paraffin scraper tools are co-axially mounted on a particular length of sucker rod with the movement of a particular scraping tool being limited to alternation between upper and lower stop means mounted on a length of sucker rod. The manner in which the several items of equipment are integrated into a system of apparatus is illustrated in FIGS. 6, 7, 8 and 12 of the Drawings and should be readily self evident from examination of said figures in the light of the descriptive material in the foregoing disclosure.

The several scraper tools can be co-axially mounted on and ride up and down on the sucker rod line all during the pumping operation and the random agitation of the plurality of slidable scraper tools will prevent build up of paraffin and asphalt deposits to some extent. It should be remembered that sucker rods also become coated with deposits and eventually stick to deposits on the walls of the oil well tubing 30 and it should be noted that the paraffin scraper structures disclosed herein scrape both the sucker rod and the walls of the oil well tubing as the scrapers move up and down. If a dent or crooked spot develops in either the sucker rod string or the oil well tubing so that the sucker rods rub and damage the walls of the tubing, one of the spaced apart sldiable scrapers will eventually get impacted between the sucker rod line and the walls of the tubing at the point of the damage. In such position, the impacted paraffin spacer will function as a self positioning centering spacer so that the rub wear damage is transferred from the expensive oil well tubing to the less expensive sucker rod and scraper tool offering another feature of protective utility.

It will be appreciated that the mere random agitation motion of the plurality of scraper tools as pumping action and oil flow occurs will produce only a minor amount of preventive build up of paraffin and asphalt deposits. When serious clogging of the well begins to load the pumping action of the sucker rod line in spite of the minor agitation of the string of plural scrapers, the operator will suspend pumping and lift the sucker rod line through several feet of upward pull at the surface until the sucker rod line is lifted off of the bottom of the well. This lifting action will drag the sucker rod line and each of the plurality of attached scraper tools upward through a considerable distance of tubing and the suspended sucker rod line will now weigh several thousand pounds. The operator then drops the sucker rod line and the collective weight of the sucker rod line is driven or hammered against the centering collars of the several paraffin scraper tools mounted on sucker rod line when the stop means and connective rod boxes of the sucker line strike the top collars of the scraper tools. This action drives the several scraper tools through the corrosive deposits on the walls of the tubing scraping and cutting loose said deposits. This operation of lifting and dropping the sucker rod line and associated plurality of scraper tools mounted therein can be repeated as often as necessary to break up the deposits and loosen the friction of pumping the sucker line.

Much of the scraped off paraffin and deposits will flow upward with the pumped crude oil flow passing through the open spaces of the scraper tools. However, when pumping action in the well is suspended and crude oil ceases to flow upward both the scraper tools and the broken up particles of paraffin will start settling back toward the bottom of the well. However, the metal scraper tools are heavier than the particles of paraffin and will settle faster than the paraffin. When the scraper tools settle against the lower cone shaped seat stop means the combination of the cone shaped seat stop means plus the mass of the scraper ring will block off the tubing and prevent any further sinking of the paraffin particles that are floating in the crude oil. When pumping is resumed the upflow of oil will drive the small slidable scraper tools away from the seat valves and the upflow of oil and paraffin particles to the surface will be continued.

In spite of all of this preventive and delaying action the interior of the oil well tubing will eventually become so coated with obstructive deposits that more serious cleaning and overhall of the well will be necessary. At such time the operator will pull the entire sucker rod line to the surface for cleaning. As the operator pulls the sucker rod line each of the plurality of scraper tools thereon will set down on their lower seat valve stops and each scraper tool will successively and repeatedly scrape the tubing walls as each is pulled to the surface. Since scraped off particles of paraffin and asphalt cannot get past the now closed seat valve stop means, the deposit particles trapped between the spaced apart scrapers will be pulled to the surface and emptied in increments. The thoroughness this cleaning action with the aid of the simple scraper tools and associated apparatus disclosed herein can delay the drastic necessity of pulling and cleaning the oil well tubing for such an extended period of operation to as to more than pay for the cost of this simple system of scraping and cleaning. Many low grade marginal wells that are now abandoned because of clogging excesses of paraffin and asphalt deposits make the cost of cleaning the well by present methods excessive in comparison to the small low flow recovery may well prove to have a further period of useful and profitable life with the aid of the simple scraping and cleaning apparatus disclosed by this invention.

ADVANTAGES OF THE INVENTION

A material advantage of the invention is that it provides for a simple, durable and inexpensive paraffin scraping and removal tool that can be semi-permanently installed on the oil well sucker rod string and remain in place and semi-operative concurrently with pumping production and instantly available for more drastic scraping and cleaning action when needed thereby minimizing the expense and down time normally involved in pulling the oil well tubing for cleaning purposes.

Another advantage of the invention lies in having devised an inexpensively manufactured and nearly indestructable paraffin scraping tool that will have no moving parts to break off, that will be so impervious to wear by semi-permanent installation and usage as to make it practical for the operator to install a plurality of said paraffin scraping tools in an oil well and leave them in place.

A further advantage of the invention is found in having provided a paraffin scraper tool that can be left in the well semi-permanently during pumping operations so as to provide continuous agitation and scraping action in order to prevent the build up of paraffin or asphalt deposits before stubborn tenacious deposits have formed.

Still another advantage of the invention disclosed herein lies in having devised a sturdy, simple, inexpensive and almost indestructable paraffin scraper tool and associated apparatus that can rise through a limited distance with the up-flow of oil through the oil well tubing or by gravity fall by its own weight through a limited distance but with means for supplemental hammer driving of the scraper tool by lifting or dropping the weight of the sucker rod line through an extended piston stroke so as to drive the upper and lower stop means against the top or the bottom of the scraper tool.

A still further and somewhat unexpected side advantage of this invention lies in having provided a paraffin scraping tool of such substantial structure as to have use-value in hammering out dents in the walls of the oil well tubing by using the weight of the sucker rod string to drive the scraper tool through the dented area in the tubing.

Another advantage of the invention derives from having devised a simple scraper tool that can simultaneously scrape both the sucker rod line and the inside surfaces of the oil well tubing. A further advantage of the paraffin scraper tool provided by this invention resides in the fact that because of its concentric design it can often function as a means of spacing and centering the moving sucker rods within the oil well tubing so as to prevent frictional wear and damage to the oil well tubing.

Another advantage of the invention is that oil well tube walls may be scraped and cleaned while in place in the ground, eliminating the necessity of puling the tube for cleaning purposes.

Still another advantage of the invention is that well tubing is cleaned and scraped by either upward (extractive) or downward (insertive) motion of the sucker rod-scraping tool mechanism and drastic scraping and cleaning action can be initiated by simply increasing the length of the piston stroke of the sucker rod line.

A material advantage of the paraffin scrapers disclosed by this invention is that they can be installed with insertion of the sucker pumping rod string and remain relatively inert or passive during regular pumping operations but also be available for standby readiness for immediate initiation of scraping and cleaning action when needed without the excessive down time customarily required for the temporary insertion of leased commercial scraping and cleaning equipment before the cleaning operation can be started. This availability of continuous or frequent scraping of paraffin and asphalt restricts the thickness of contaminating deposits to within a workable range so that pumping interruptions for major overhaul and reconditioning of the well with the expense of contract service specialists being held to a minimum.

Although this specification describes but a single embodiment of the Invention with certain applications thereof, it should be understood that structural or material rearrangements of adequate or equivalent parts, substitutions of equivalent functional elements and other modifications in structure can be made and other applications devised without departing from the spirit and scope of our Invention. We therefore desire that the description and drawings herein be regarded as only an illustration of our Invention and that the Invention be regarded as limited only as set forth in the following claims.

Having thus described my Invention, I claim:

1. A freely slidable paraffin scraping and removing tool for continuing maintenance of the interior surfaces of oil well tubing comprising:

A. an annularly shaped paraffin cutting and scraping ring
   1. having an exterior structural appearance like that of a thick metal washer, and
   2. having a thickened exterior circumference of such size as to frictionally engage and scrape the interior walls of one of the standard sizes of oil well tubing, and
   3. with the inside circumference of said paraffin cutting and scraping ring being substantially larger than the circumference of sucker rods normally employed in oil well drilling and pumping operations such as to permit oil and dislodged paraffin particles to pass through said scraper ring even when a moving sucker rod is in place;

B. an upper annularly shaped aligning and centering guide collar spaced apart from said paraffin cutting and scraping ring
   1. with the outside circumference of said guide collar being smaller in size than the outside circumference of the paraffin cutting and scraping ring, and
   2. a guide hole aperture provided through said aligning and centering guide collar having an inside diameter slightly larger than the diameter of the sucker rod being employed in the oil well; and C. a plurality of circumferentially spaced apart vertical spacer legs
   1. interconnecting and separating the paraffin cutting and scraping ring and the aligning centering guide collar,
   2. with open space apertures between said spaced apart legs forming exit flow ports permitting the flow of oil and paraffin particles through said scraper tool and out via said exit ports;

said scraper tool being designed to move freely up and down on an oil well sucker rod with oil and paraffin particles passing through the central cavity enclosed in the space between the paraffin cutting and scraping ring and the upper aligning and centering guide collar and the space enclosed by the circumferentially spaced apart spacer legs.

2. The paraffin scraping and removing tool described in claim 1 with the circumferentially spaced apart spacer legs A. said spacer legs being formed by elongated metal bars of rectangular cross section; and B. arranged in an inclined slope between the paraffin cutting and scraping blade and the upper guide collar such that the narrow side of each of the spacer legs faces toward the outside circumference of said scraper ring and guide collar leaving maximum exit port area between said spacer legs; and providing said paraffin scraper tool with a generally truncated frusto-conical appearance.

3. The paraffin scraping and removing tool described in claim 1 in which the annularly shaped paraffin cutting and scraping ring is provided with a concave arcuate cutting blade cut into the undersurface of said scraping ring.

4. A paraffin scraping and removing tool assembly as described in claim 1 together with A. a length of oil well sucker rod that passes through the center opening in the upper annularly shaped aligning and centering collar and passes through the center opening in the annularly shaped paraffin cutting and scraping ring so that the paraffin cutting tool can freely slide up and down on the length of sucker rod;

B. an upper stop means which may be a rod box connector between adjacent sucker rods;

C. a lower stop means which may be a frusto-conically shaped seat valve structure 1. adapted to nest into the concave arcuate cutting blade cut into the undersurface of said paraffin scraping ring such that said truncated frusto-conical seat functions as both a lower stop means and as a seat valve driving oil and loosened paraffin particles upward when the paraffin scraper tool is driven upward by an upstroke of the sucker rod,
2. a tubular opening vertically cut through said truncated frusto-conical seat stop structure to permit said seat valve stop means to be concentrically mounted on the sucker rod, and
3. securing means to permit said seat valve stop means to be attached at a selected point to the sucker rod.

5. A freely slidable unitary cast metal paraffin scraping and removing tool for continuing maintenance of the interior surfaces of oil well tubing comprising:

A. an annularly shaped paraffin scraping ring 1. having an exterior structural appearance like that of a short length of thick metal tubing with an extended upper portion having the appearance of a truncated cone on top of the cylindrically shaped tubular paraffin scraping ring,
2. having an exterior circumference of such size as to frictionally engage and scrape the interior walls of one of the standard sizes of oil well tubing, and
3. with the inside circumference of said paraffin scraping ring being substantially larger than the circumference of sucker rods normally employed in oil well drilling and pumping operations such as to permit oil and dislodged paraffin particles to pass through said scraper ring even when a moving sucker rod is in place;

B. an upper annularly shaped aligning and centering guide collar spaced apart from said paraffin scraping ring, 1. said aligning and centering guide collar being fabricated as a cone shaped extension of the same metal tubular casting as the paraffin scraping ring,
2. with the upper outside circumference of said cone shaped guide collar being smaller in size than the outside circumference of the paraffin scraping ring, and
3. a guide hole aperture provided through said tubular aligning and centering guide collar having an inside diameter slightly larger than the diameter of the sucker rod being employed in the oil well;

C. a plurality of vertical apertures cut into the upper portion of the cone shaped tubular casting from which the paraffin scraping ring is fabricated such that 1. the open space apertures cut into said cone shaped surface form a plurality of exit flow ports permitting the flow of oil and paraffin particles through said scraper tool and out via said exit ports, while the
2. inclined strips of material between said vertical aperture exit ports form a plurality of circumferentially spaced apart inclined spacer legs that merge into the aligning and centering guide collar at their upper end;

said scraper tool being designed to move freely up and down on an oil well sucker rod with oil and paraffin particles passing through the central cavity enclosed in the space between the paraffin cutting and scraping ring and the upper aligning and centering guide collar and the space enclosed by the circumferentially spaced apart spacer legs.

6. The improved and simplified tool for scraping and removing paraffin from the inside surfaces of oil well tubing as described in claim 5 together with the addition of an arcuate cutting blade cut into the undersurface of said tubular scraping ring to provide both cutting and scraping action against the inside walls of the oil well tubing being cleaned.

7. Improved and simplified apparatus for scraping and removing paraffin from the inside surfaces of oil well tubing, said improved apparatus comprising:

A. a freely slidable unitary cast metal paraffin cutting and scraping tool having 1. a tubular shaped lower portion designated as a paraffin scraping ring,
2. having an exterior circumference of such size as to frictionally engage and scrape the interior walls of one of the standard sizes of oil well tubing,
3. with the inside circumference of said paraffin cutting and scraping ring being substantially larger than the circumference of sucker rods normally employed in oil well drilling and pumping operations such as to permit oil and dislodged paraffin particles to pass through said scraper ring even when a moving sucker rod is in place,
4. the center portion of said paraffin scraping tool being provided with an inwardly sloping surface to form the sides of a truncated cone, with
   a. a plurality of apertures forming exit flow ports being cut through the sloping walls of cone shaped mid-portion of said paraffin scraper tool, with
   b. the material between the exit flow port apertures forming a plurality of circumferentially spaced apart vertical spacer legs, and
5. with said plurality of spaced apart spacer legs merging into an annular cone shaped centering guide collar spaced apart from said paraffin scraping ring,
   a. with the outside circumference of said guide collar being smaller in size than the outside circumference of the paraffin cutting and scraping ring, and b. a guide hole aperture provided through said aligning and centering guide collar having an inside diameter slightly larger than the diameter of the sucker rod being employed in the oil well;

B. a length of oil well sucker rod that passes through the center opening in the upper annularly shaped aligning and centering collar and passes through the center opening in the annularly shaped paraffin cutting and scraping ring so that the paraffin cutting tool can freely and slidably ride up and down on the length of sucker rod;

C. an upper stop means comprising a rod box connector between adjacent sucker rods; and D. a lower stop means comprising a frustro-conically shaped seat valve structure 1. adapted to nest into the concave arcuate cutting blade cut into the undersurface of said paraffin scraping ring such that said truncated frusto-conical seat functions as both a lower stop means and as a seat valve driving oil and loosened paraffin particles upward when the paraffin scraper tool is driven upward by a cleaning upstroke of the sucker rod,
2. a tubular opening vertically cut through said truncated frusto-conical seat stop structure to permit said seat valve stop means to be concentrically mounted on the sucker rod, and
3. securing means to permit said seat valve stop means to be attached to a selected point on the sucker rod.

8. The improved and simplified apparatus for scraping and removing paraffin from the inside surfaces of oil well tubing as described in claim 7 together with the addition of an arcuate cutting blade cut into the undersurface of said tubular scraping ring to provide both cutting and scraping action against the inside walls of the oil well tubing being cleaned.

9. A freely slidable paraffin scraping and removing tool for continuing maintenance of the interior surfaces of oil well tubing comprising:

A. an annularly shaped paraffin scraping ring 1. having an exterior structural appearance like that of a short length of thick metal tubing,
2. having an exterior circumference of such size as to frictionally engage and scrape the interior walls of one of the standard sizes of oil well tubing, and
3. with the inside circumference of said paraffin scraping ring being substantially larger than the circumference of sucker rods normally employed in oil well drilling and pumping operations such as to permit oil and dislodged paraffin particles to pass through said scraper ring even when a moving sucker rod is in place;

B. an upper annularly shaped aligning and centering guide collar spaced apart from said paraffin cutting and scraping ring, 1. said aligning and centering guide collar being fabricated from a short length of metal tubular material,
2. with the outside circumference of said tubular guide collar being smaller in size than the outside circumference of the paraffin scraping ring, and
3. a guide hole aperture provided through said tubular aligning and centering guide collar having an inside diameter slightly larger than the diameter of the sucker rod being employed in the oil well;

C. a plurality of vertical slots circumferentially and evenly spaced apart and cut into the upper portion of the tubular material from which the paraffin scraping ring is fabricated such that 1. the open space slots form a plurality of exit flow ports permitting the flow of oil and paraffin particles through said scraper tool and out via said exit ports, while the
2. tubular material between said vertical slot exit ports form a plurality of circumferentially spaced apart vertical spacer legs in continuing alignment with the interior and exterior tubular surfaces of the paraffin scraping ring;

D. said upper aligning and centering guide collar being mounted and secured in position just inside the upper portion of said ring of spaced apart vertical spacer legs;

said scraper tool being designed to move freely up and down on an oil well sucker rod with oil and paraffin particles passing through the central cavity enclosed in the space between the paraffin cutting and scraping ring and the upper aligning and centering guide collar and the space enclosed by the circumferentially spaced apart spacer legs.

10. The improved and simplified apparatus for scraping and removing paraffin from the inside surfaces of oil well tubing as described in claim 9 together with the addition of an arcuate cutting blade cut into the undersurface of said tubular scraping ring to provide both cutting and scraping action against the inside walls of the oil well tubing being cleaned.

11. A freely slidable paraffin scraping and removing tool for continuing maintenance of the interior surfaces of oil well tubing, comprising, in combination:

A. ring means for cutting and shaping paraffin, and arranged for frictionally engaging and scraping interior walls of standard oil well tubing while being spaced from a sucker rod disposed within the tubing, the spacing between the ring means and sucker rod permitting oil and dislodged paraffin particles to pass through the ring means even when the sucker rod is in place;

B. guide means connected to the ring means and cooperable with the sucker rod for aligning and centering the ring means relative to the sucker rod; and C. a pair of stop means, each having an opening fit to the sucker rod simultaneously in a respective one of two different locations, one upper and the other lower, on the sucker rod for limiting relative displacement between the sucker rod and the ring means and guide means, the tool arrangeable for riding freely up and down the sucker rod between the part of the stop means associated with the sucker rod and permitting the ring means to scrape paraffin particles off the interior walls of the tubing, and the one of the stop means fit at the lower of the locations on the sucker rod cooperating with the ring means for virtually closing and sealing off and cleaning out the oil well tubing when the sucker rod is pulled out of the tubing.

* * * * *